US010532850B2

(12) United States Patent
Su

(10) Patent No.: US 10,532,850 B2
(45) Date of Patent: Jan. 14, 2020

(54) FOLDING BOX

(71) Applicant: SHANGHAI HONGYAN RETURNABLE TRANSIT PACKAGING CO., LTD, Shanghai (CN)

(72) Inventor: Yongping Su, Shanghai (CN)

(73) Assignee: SHANGHAI HONGYAN RETURNABLE TRANSIT TRANSIT PACKAGINGS CO., LTD., Shanghai (CN)

( * ) Notice: Subject to any disclaimer, the term of this patent is extended or adjusted under 35 U.S.C. 154(b) by 169 days.

(21) Appl. No.: 15/543,814

(22) PCT Filed: Jan. 15, 2016

(86) PCT No.: PCT/CN2016/071066
§ 371 (c)(1),
(2) Date: Jul. 14, 2017

(87) PCT Pub. No.: WO2016/112866
PCT Pub. Date: Jul. 21, 2016

(65) Prior Publication Data

US 2018/0002063 A1 Jan. 4, 2018

(30) Foreign Application Priority Data

Jan. 16, 2015 (CN) ..... 2015 1 0023594

(51) Int. Cl.
*B65D 8/04* (2006.01)
*B65D 6/18* (2006.01)
(Continued)

(52) U.S. Cl.
CPC ..... *B65D 7/26* (2013.01); *B65D 7/30* (2013.01); *B65D 11/1833* (2013.01);
(Continued)

(58) Field of Classification Search
CPC ..... B65D 7/26; B65D 7/30; B65D 11/1833; B65D 11/26; B65D 21/0212;
(Continued)

(56) References Cited

U.S. PATENT DOCUMENTS 4,674,647 A * 6/1987 Gyenge ..... B65D 19/18 220/1.5
4,923,079 A * 5/1990 Foy ..... B65D 19/18 220/326
(Continued)

FOREIGN PATENT DOCUMENTS

CA 2273556 11/2000
CN 1835868 9/2006
(Continued)

OTHER PUBLICATIONS

International Search Report for international appl. No. PCT/CN2016/071066, dated Apr. 6, 2016 (5 pages).
(Continued)

*Primary Examiner* — Ernesto A Grano
(74) *Attorney, Agent, or Firm* — Hamre, Schumann, Mueller & Larson, P.C.

(57) ABSTRACT

A folding box (100), comprising: a bottom plate (1), and a pair of first side plates (2) and a pair of a second side plates (3) capable of being folded with respect to the bottom plate (1). The first side plates (2) and the second side plates (3) are releasably interlocked via a locking mechanism (4). The locking mechanism (4) comprises a handle (41), a locking member (42), and a guidance feature (31). When the first side plates (2) and the second side plates (3) are in a locked state, the handle (41) restricts the position of the locking member (42), thus limiting the movement of the locking member (42), when the handle (41) restricts the position of the locking member (42), thus limiting the movement of the locking member (42), when the handle (41) moves and
(Continued)

provides the locking member (42) space required for movement of the locking member (42), the locking member (42) cooperates with the guidance feature (31) to drive the locking member (42) to move so as to unlock the same. When the folding box is empty and recycled, the side plates are easy and convenient to unlock, and are difficult to be unlocked by an accidental triggering when using.

13 Claims, 17 Drawing Sheets

(51) Int. Cl.
*B65D 6/26* (2006.01)
*B65D 6/34* (2006.01)
*B65D 21/02* (2006.01)

(52) U.S. Cl.
CPC ..... *B65D 11/26* (2013.01); *B65D 21/0212* (2013.01); *B65D 2519/009* (2013.01); *B65D 2519/00034* (2013.01); *B65D 2519/00422* (2013.01)

(58) Field of Classification Search
CPC ..... B65D 2519/00034; B65D 2519/00422; B65D 2519/009
USPC ..... 220/700, 666, 7, 6, 6.7, 4.28
See application file for complete search history.

(56) References Cited

U.S. PATENT DOCUMENTS 5,062,671 A * 11/1991 Goetz ..... E05C 1/10 292/175
5,199,592 A * 4/1993 Reiland ..... B65D 11/1833 16/366
5,632,392 A * 5/1997 Oh ..... B65D 11/1833 220/6
5,853,099 A * 12/1998 Lessard ..... B65D 11/1833 220/7
6,290,081 B1 * 9/2001 Merey ..... B65D 11/1833 220/7
6,293,418 B1 * 9/2001 Ogden ..... B65D 11/1833 220/6
6,601,724 B1 * 8/2003 Koefelda ..... B65D 11/1833 220/4.28
6,772,897 B2 * 8/2004 Kellerer ..... B65D 11/1833 220/6
6,843,386 B2 * 1/2005 Raghunathan ..... B65D 11/1833 220/7
6,899,242 B2 * 5/2005 Overholt ..... B65D 11/1833 220/7
7,017,765 B2 * 3/2006 Overholt ..... B65D 11/1833 220/6
7,017,766 B2 * 3/2006 Hsu ..... B65D 11/1833 220/6
7,059,489 B2 * 6/2006 Apps ..... B65D 11/1833 220/6
7,063,223 B2 * 6/2006 Iwahara ..... B65D 11/1833 220/6
7,195,127 B2 * 3/2007 Hsu ..... B65D 11/1833 220/6
7,195,128 B2 * 3/2007 Murakami ..... B65D 11/1833 206/600
7,416,092 B2 * 8/2008 Dubois ..... B65D 19/18 206/511
7,641,066 B2 * 1/2010 Baltz ..... B65D 11/1833 220/6
7,694,836 B2 * 4/2010 Overholt ..... B65D 11/1833 220/6
7,717,283 B2 * 5/2010 Apps ..... B65D 21/062 206/506
7,861,878 B2 * 1/2011 Escarpa Gil ..... B65D 11/1833 220/7
8,807,367 B2 * 8/2014 Bobritski ..... B65D 11/18 220/4.28
9,033,171 B2 * 5/2015 Bobritski ..... B65D 11/18 220/6
9,422,087 B1 * 8/2016 Poran ..... B65D 11/1833
10,065,763 B2 * 9/2018 Wilcox ..... B65D 11/1833
2004/0069780 A1 * 4/2004 Apps ..... B65D 11/1833 220/7
2007/0125779 A1 * 6/2007 Cope ..... B65D 11/1833 220/6
2007/0145053 A1 * 6/2007 Escarpa Gil ..... B65D 11/1833 220/7
2007/0272579 A1 * 11/2007 Cavalcante ..... B65D 11/1833 206/506
2009/0101640 A1 * 4/2009 Hadar ..... B65D 11/1833 220/7
2010/0230406 A1 * 9/2010 Yamauchi ..... B65D 11/1833 220/7
2010/0294757 A1 11/2010 Pits
2010/0320202 A1 * 12/2010 Yamauchi ..... B65D 11/1833 220/6
2012/0091133 A1 * 4/2012 Escarpa Gil ..... B65D 11/1833 220/7
2013/0320007 A1 * 12/2013 Orgeldinger ..... B65D 88/524 220/7
2014/0144909 A1 * 5/2014 Bobritski ..... B65D 11/18 220/7
2014/0312034 A1 * 10/2014 Bobritski ..... B65D 11/18 220/4.33
2016/0236818 A1 * 8/2016 Poran ..... B65D 11/1833

FOREIGN PATENT DOCUMENTS

CN 201411098 2/2010
CN 201411098 Y 2/2010
CN 201472759 5/2010
CN 104691892 6/2015
EP 0785142 7/1997
EP 1894849 3/2008
EP 2338803 6/2011
JP 2005082157 3/2005
JP 2009269656 11/2009
WO 00/68099 11/2000
WO 0068099 A1 11/2000
WO 2009050689 4/2009
WO 2011062565 5/2011

OTHER PUBLICATIONS

Examination report issued in Australian Patent Application No. AU2016207108, dated Feb. 21, 2018.

* cited by examiner

FOLDING BOX

FIELD

This invention relates to a container, particularly relates to a folding box.

BACKGROUND

The existing folding box has side plates with regular thickness and height. When in use, the side plates are unfolded and upright oppositely, and four side plates are interlocked, thus forming a relatively closed space to accommodate the cargo. And after cargo is empty, the box needs to be recycled. In order to maximize the cost savings, the side plates of the box are to be folded, so that more of the recycled box can be accommodated in the same space.

In the recycling process of the folding box, it's necessary to keep easy cleaning, and clean after use is particularly important for the folding box used to load fruits, vegetables and other fresh foods. And meanwhile, in use of the box, it is necessary to not only ensure safe and reliable in case of loading, but also to make the side plates simple and easy to be unlocked and folded in the case of emptying.

The side plates of the existing folding box, such as the folding box disclosed in Patent application WO2011062565A1, can be quickly locked, but the handle of the box is mounted on the outer edge of the side plates. When the folding box is in use, it will suffer an expansion force from the loaded cargo applying to the side plates, and the handle needs an assembly gap for moving up and down, which is easy to cause the handle portion to be deformed to protrude the outer edge of the side plates. In such cases, it is easy to trigger the handle and make it unlock in the course of moving or using the foldable container, which brings security risks for it. In addition, the side plates of the folding box is provided with a large number of the reinforcing ribs to strengthen the strength of the side plates, which makes it easy to dirty in use of the box and hard to be quickly cleaned after use, thus it is not conducive to the food hygiene such as fruits, vegetables and other fresh foods.

SUMMARY

The object of the present invention is to provide a foldable and double smooth folding box with a smooth appearance without ribs, and liable to quickly clean, based on the deficiency of the prior art. When the box is empty and recycled, the side plates are easy and convenient to unlock, and the handle is provided on the inner side of the side plates, which is difficult to be unlocked by an accidental triggering when using.

In order to achieve the above object, the present invention provides a folding box comprising a bottom plate, a pair of first side plates and a pair of second side plates, the first side plates and the second side plates are hinged to the bottom plate and foldable with respect to the bottom plate, and the first side plates and the second side plates are releasably interlocked via a locking mechanism, wherein the locking mechanism comprises:

a handle being movably mounted on the first side plate;

a locking member for interlocking adjacent first side plates and the second side plates;

a guide feature provided on the second side plate;

wherein when the first side plates and the second side plates are in a locked state, the handle restricts position of the locking member, thus limiting movement of the locking member, after the handle moves and provides the locking member with space required for the movement, the locking member being capable of cooperating with the guide feature so as to drive the locking member to move and thus being unlocked.

Preferably, the guide feature is provided on the inner wall of the second side plate.

Preferably, the guide feature is provided with a projection with a guide slope.

Preferably, the first side plate is shorter than the second side plate.

Preferably, the handle is mounted on the inner side of the first side plate and can move up and down along the first side plate.

Preferably, both ends of the handle is provided with a handle elastic piece, the handle elastic piece is used for driving the handle to move then reset.

Preferably, the handle moves upwardly or downwardly by a predetermined distance so as to provide the locking member space required for its movement.

Preferably, the locking member is provided with a latch and a first latch tab, the latch is capable of cooperating with the guide feature so as to drive the latch to move and drive the first latch tab to deform and thus being unlocked, upon locking, the first latch tab can reset and drive the latch to reset.

Preferably, the second side plate is provided with a stop, and edges of both left side and right side of the second side plate extend vertically a connection portion, upon locking, one end of the locking member is located between the stop and the connection portion, and the guide feature is provided on the stop.

In one embodiment, the inner wall of the first side plate extends a mounting wall parallel to the inner wall of the first side plate, and one of the first side plate and the handle is provided with a hook and the other is provided with trough, and the handle is housed in the space formed between inner wall of the first side plate and the mounting wall and the hook cooperates with the trough so that the handle can slide up and down along the first side plate.

In one embodiment, one end of the locking member is provided with a latch, and the other end is provided with a latch tab, and the outer side is provided with a stopper projection and a trigger projection; and the first side plate is provided with a stopper hole and a trigger hole and the inner side is provided with a stop, and the second side plate is provided with a trigger portion; wherein the stopper projection is engaged with the stopper hole so that the locking member can be held in the locked state, and the trigger projection cooperates with the trigger portion so that the stopper projection can disengage from the stopper hole, and the stop cooperates with the first latch tab, so that the latch tab is deformed upon unlocking and drive the locking member to reset upon locking.

Preferably, the first latch tab is V-shaped elastic piece.

Preferably, the locking member is provided with a second latch tab, and the second latch tab is provided with the stopper projection and a trigger projection, and the first side plate is provided with the corresponding stopper hole and trigger hole.

Preferably, the locking member is provided with a third latch tab on the upper side or the lower side of the locking member.

In one embodiment, the locking member is provided with a latch and a first latch tab, one end of the first latch tab is hinged to the first side plate, and the other end is fixed on the latch, and when first side plates and second side plates are in the locked state, one end of the latch is restricted by the handle, while the other end of the latch extends into the second side plate, upon unlocking, one end of the latch disengages from the handle and the other end of the latch cooperates with the stop feature so that the latch disengages from the second side plate and thus being unlocked.

In one embodiment, the handle and the locking member is configured that when the first side plates and the second side plates are in the locked state, both ends of the handle respectively abut against one end of two locking members, while after the handle moves by a predetermined distance, both ends of the handle disengage from the locking member.

In one embodiment, both ends of the handle are provided with a gripping portion, when the first side plates and the second side plates are in the locked state, and both ends of the handle respectively hold one end of two locking member, while the handle moves by a predetermined distance and the first side plate is pushed toward the inside of the folding box, the gripping portion of the handle disengages from the locking member.

In one embodiment, both ends of the handle are provided with the handle guide slope, one end of the locking member is provided with corresponding locking guide slope, upon unlocking, the locking guide slope can move along the handle guide slope.

In one embodiment, the stopper feature is configured as a projection provided on inner wall of the second side plate with a guide slope, and the locking member is provided with a latch and a latch tab, and one end of the latch tab is hinged to the first side plate, and the other end is fixed on the latch, when the first side plates and the second side plates are in a locked state, one end of the latch is held in the gripping portion of the handle while the other end of the latch extends into the second side plate, upon unlocking, one end of the latch disengages from the handle and the other end of the latch cooperates with the raised guide slope so that the latch disengages from the second side plate and thus being unlocked.

According to another aspect of the present invention, also provided a folding box, the folding box comprising a bottom plate, a pair of first side plates and a pair of second side plates, the first side plates and the second side plates being hinged to the bottom plate and capable of being foldable with respect to the bottom plate, and the first side plates and the second side plates being releasably interlocked via a locking mechanism, wherein the locking mechanism comprises:

a handle which is movably mounted on the first side plate;

a locking member for interlocking the adjacent first side plates and the second side plates and provided with a latch and a first latch tab;

A guide feature, which is provided on the second side plate;

wherein when the first side plates and the second side plates are in a locked state, the handle restricts the position of the locking member, thus limiting the movement of the locking member, after the handle moves and provides the locking member the space required for the movement, the locking member being capable of cooperating with the guide feature so as to drive the latch to move and drive the first latch tab to deform and thus being unlocked, upon locking, the first latch tab can reset and drive the latch to reset.

In one embodiment, the locking member also comprises a second latch tab provided on the outer side of the locking member, and the second latch tab is provided with a stopper projection and a trigger projection, and the first side plate is respectively provided with a stopper hole for housing the stopper projection and a trigger hole for housing the trigger projection, wherein the stopper projection cooperates with the stopper hole so that the locking member can be kept in an unlocked state, and the trigger projection is able to be triggered by the second side plate so that the stopper projection disengages from the stopper hole.

Preferably, the locking member also comprises the third latch tab provided on the upper side or the lower side of the locking member, and the third locking tab is capable of cooperating with the first side plate.

When the folding box is empty and recycled, the side plates are easy and convenient to unlock, and the handle is provided on the inner side of the side plate which is difficult to be unlocked by an accidental triggering when using.

DETAILED DESCRIPTION OF THE EMBODIMENTS

Figure 1:
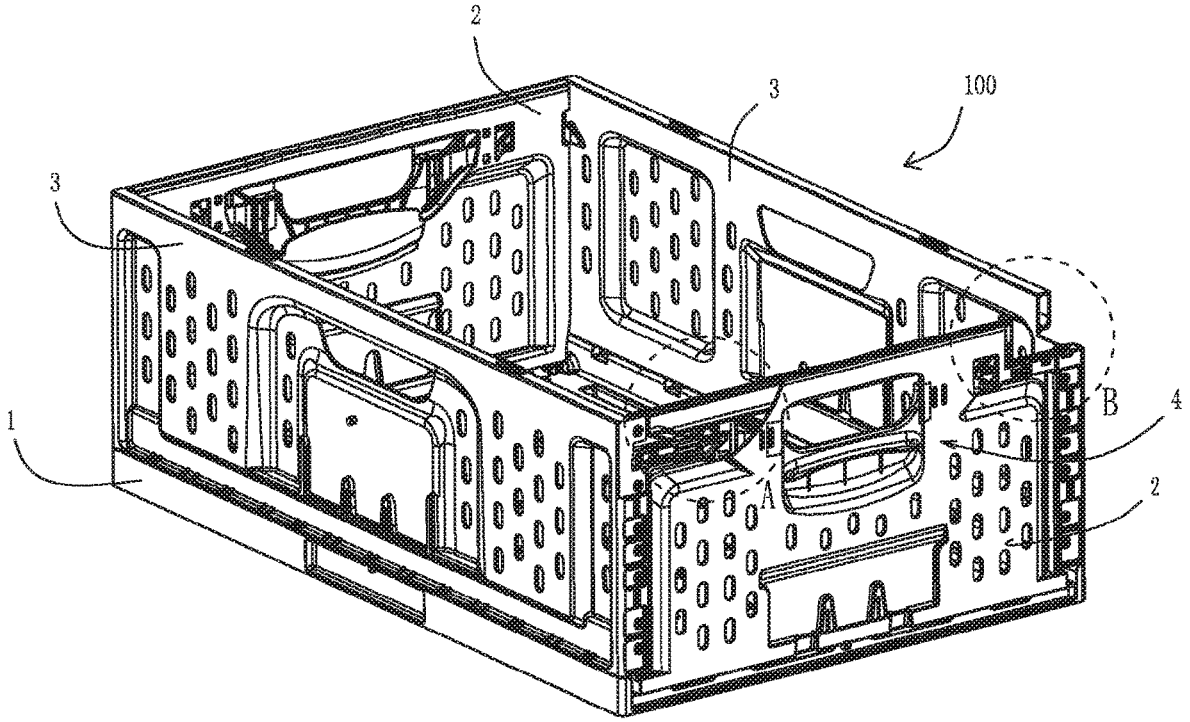
FIG. 1 is a perspective view of a folding box according to an embodiment of the present invention, part of which is cut to show a locking mechanism.

Preferred embodiments of the present invention will now be described in detail with reference to the accompany drawings in order to provide a clearer understanding of the objects, features and advantages of the present invention. It is to be understood that the embodiments shown in the drawings are not intended to limit the scope of the invention, but merely to illustrate the spirit of the invention.

FIG. 1 is a perspective view of a folding box 100 according to an embodiment of the present invention, part of which is cut to show the locking mechanism. As shown in FIG. 1, the folding box 100 comprises a bottom plate 1, a pair of first side plates 2, 2 and a pair of second side plates 3, 3, wherein the first side plates 2 and the second side plates 3 are respectively hinged to the bottom plate 1 and are capable of being foldable with respect to the bottom plate 1. The adjacent first side plate and second side plate can be releasably interlocked via a locking mechanism 4. Preferably, both of the first side plates and the second side plates are double smooth side plates. In the embodiment, the first side plate is shorter than the second side plate, so the first side plate is also referred to a short side plate and the second side plate is also referred to a long side plate. The long and short side plates are preferably made of high strength materials, such as high strength plastics.

Figure 17:
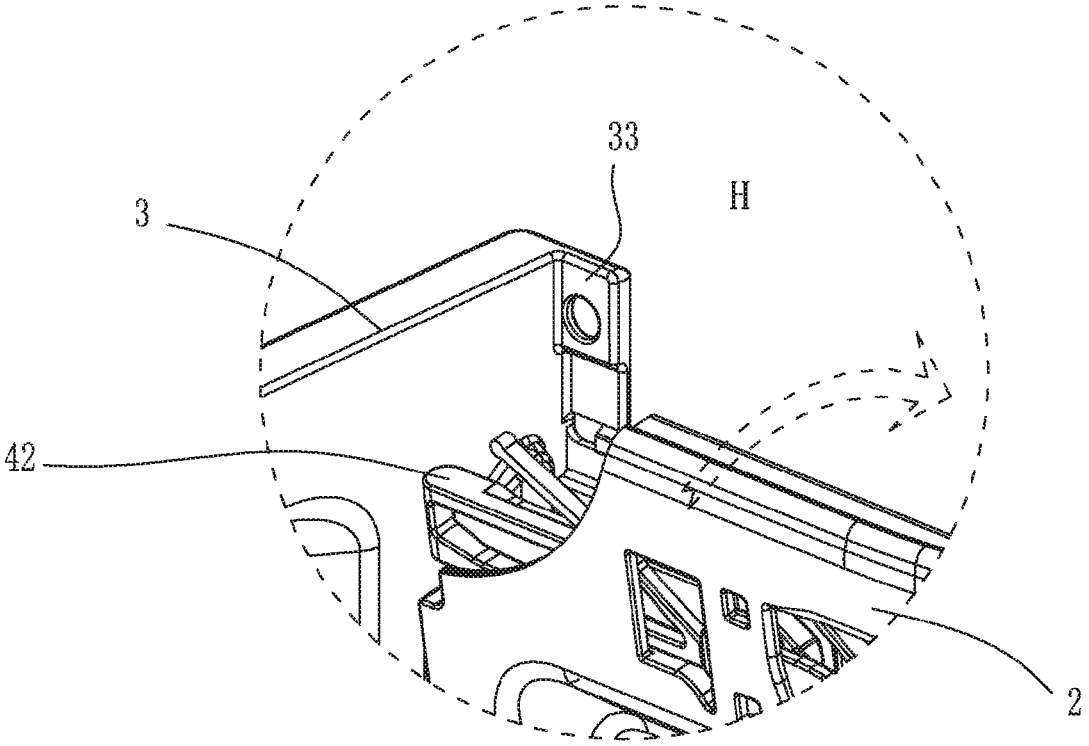
FIG. 17-19 is an enlarged view of part H of FIG. 16, showing the locking process of the adjacent side plates of the folding box.
Figure 18:
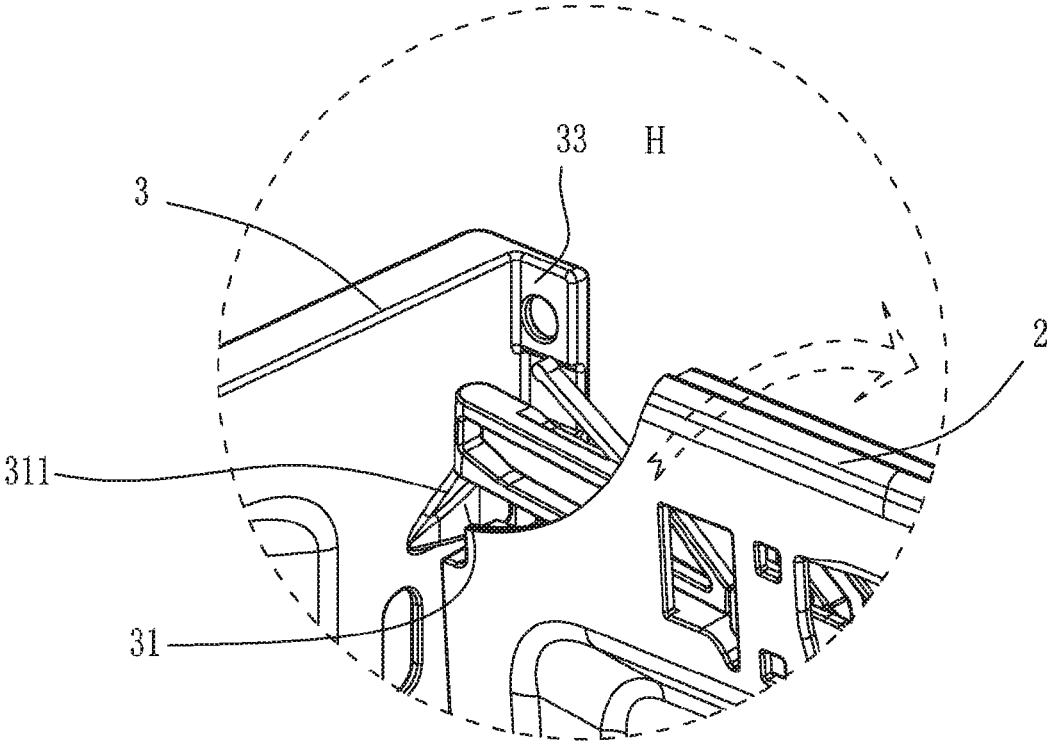
Figure 19:
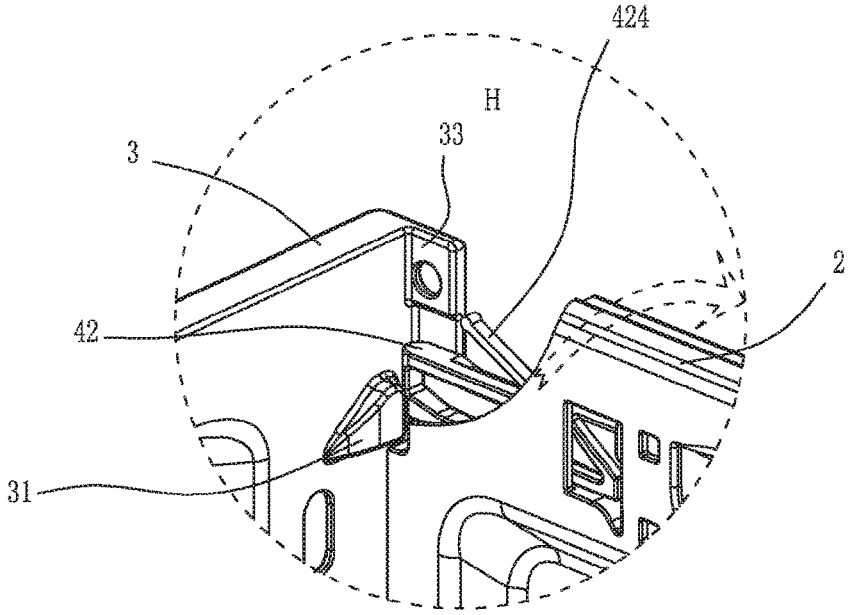
Figure 20:
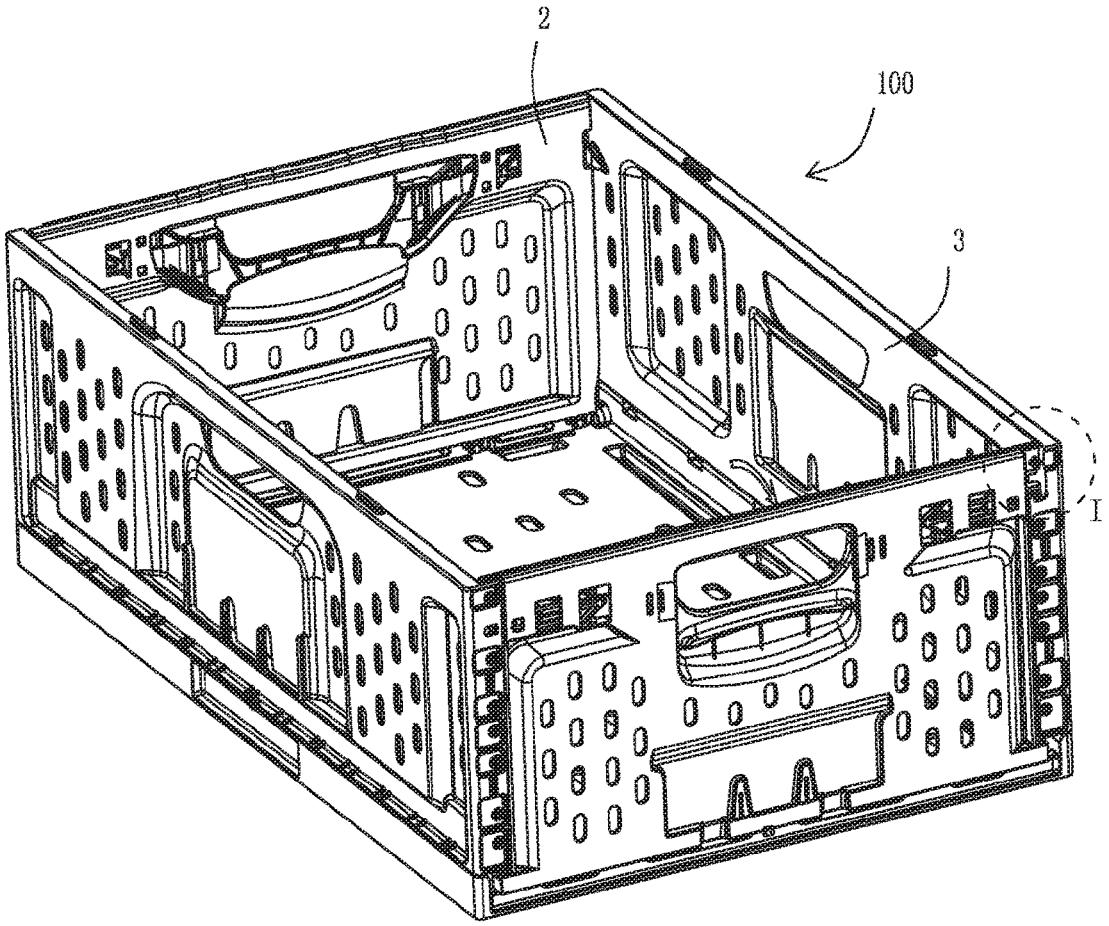
FIG. 20 is a perspective view of the folding box of FIG. 1 viewed from another perspective.
Figure 21:
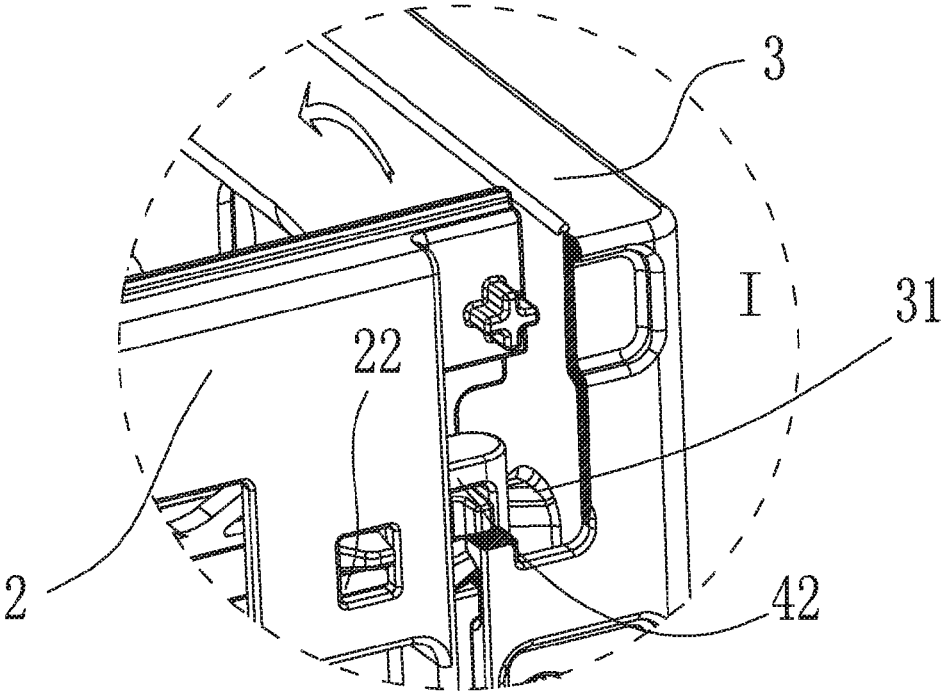
FIG. 21-23 is an enlarged view of part I of FIG. 20, showing the unlocking process of the adjacent side plates of the folding box.

In the embodiment, the locking mechanism 4 comprises a handle 41, a locking member 42 and a guide feature 31 (such as a projection 31 provided with guide slope shown in FIGS. 17 to 19), wherein the handle is mounted on the first side plate so as to be movable up and down. The locking member 42 serves to interlock the adjacent first side plate 2 and second side plate 3. Specifically, when the first side plate 2 and the second side plate 3 are in a locked state, the handle 41 restricts the locking member 42 so as to limit the movement of the locking member 42. While the handle 41 moves upwardly (in the other embodiments may also move downwardly) by a predetermined distance to provide the locking member 42 with the space required for movement, the locking member 42 is capable of cooperating with the guide feature such as a guide slope, for example, moving along the guide slope, thereby driving the locking member 42 to move (retract) and thus being unlocked, as will be described in further detail below.

Figure 2:
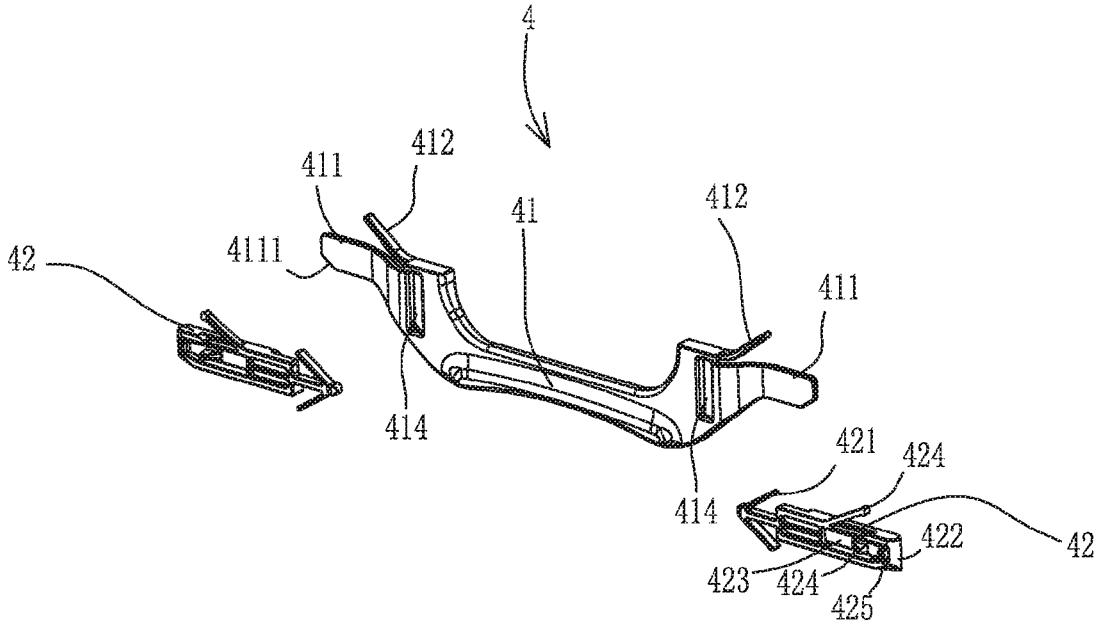
FIG. 2 is an exploded perspective view of a locking mechanism according to an embodiment of the present invention.

FIG. 2 shows an exploded perspective view of the locking mechanism 4 according to an embodiment of the present invention. As shown in FIG. 2, the middle of the handle 41 is a hand-held portion, and both ends of it are provided with an abutment portion 411. The abutment portion 411 is provided with a handle guide slope 4111. Preferably, both ends of the handle 41 are provided with a handle elastic piece 412, which is used for driving the handle 41 to reset after moving. Both ends of the handle 41 are also provided with a trough 414, which is used for cooperating with the hook 25 of the first side plates 2 (as shown in FIG. 3*b*) so that the handle 41 connects to the first side plate 2 and moves up and down along the first side plate 2.

Also as shown in FIG. 2, the locking member 42 is provided with a latch 422 at one end and a V-shaped elastic piece 421 at the other end (also referred to a first latch tab, in the other embodiments, the first latch tab may also be of other shapes, as long as it can drive the locking member to retract upon locking). The latch 422 is provided with a circular guide surface. The locking member 42 is provided with a second latch tab 423 on the outer side (preferably in the middle), and the second latch tab 423 is provided with a stopper projection 424 and a trigger projection 425. The term "outer side" herein refers to the same side as the outside of the folding box. The locking member 42 is provided with a third latch tab 424 on the upper side (in the other embodiments, the third latch tab can be provided on the lower side of the locking member). The third latch tab 424 is used when the latch is in full release (i.e., the latch is in a locked and extended state) while the first side plate is in a folded state, at this time, the first side plate moves towards upright direction (the box is unfolded and locked), and the latch will be guided along the stop of the second side plate, forcing the third latch tab 424 to elastically deform, so that the latch swings toward the upper edge of the first side plate. When the latch crosses over the stop of the long side plate, the outer side of the third latch tab is always confined in the corresponding mounting portion of the first side plate, and the latch tab is pushed between the stop of the second side plate and the connection portion of the second side plate via a resilient reset member so that the long side plate is in the locked state.

Figure 10:
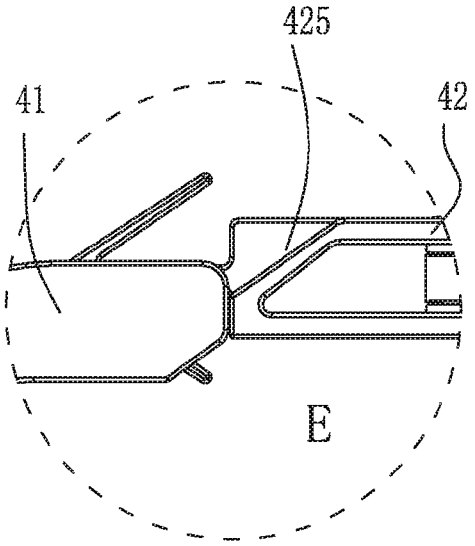
FIG. 10 is an enlarged view of part E in FIG. 9.
Figure 11:
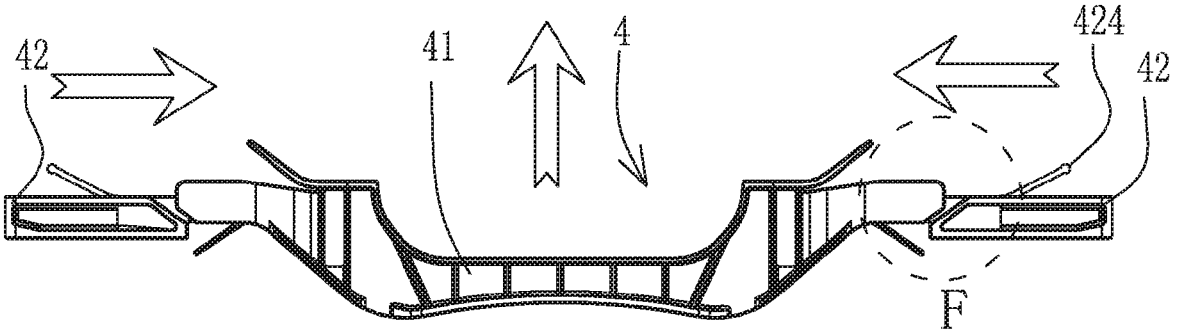
FIG. 11 is a front view of the locking mechanism of FIG. 2 in the unlocked condition.
Figure 12:
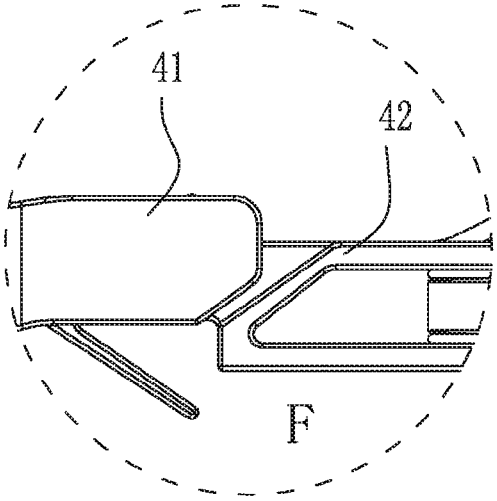
FIG. 12 is an enlarged view of part F in FIG. 11.
Figure 13:
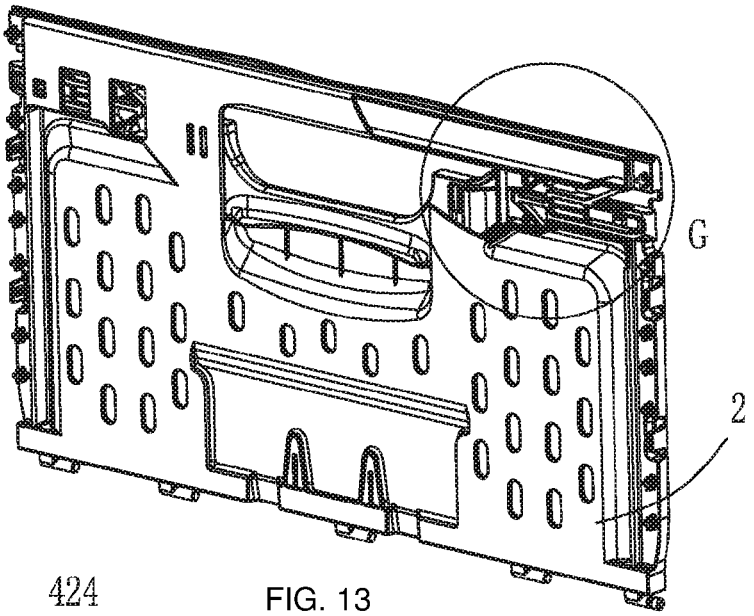
FIG. 13 shows a perspective view of the locking mechanism in the unlocked state.
Figure 14:
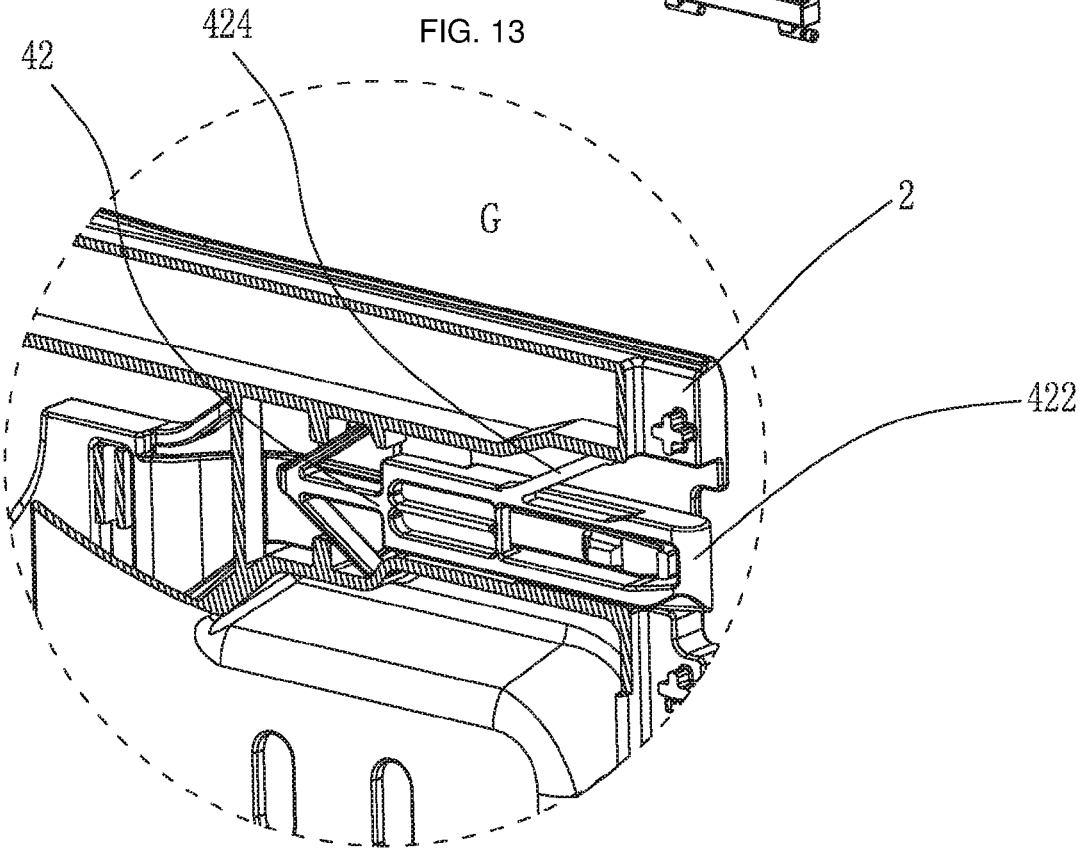
FIG. 14-15 is an enlarged view of the part G of FIG. 13, showing the movement of the locking member in the locking mechanism in the locking process.
Figure 15:
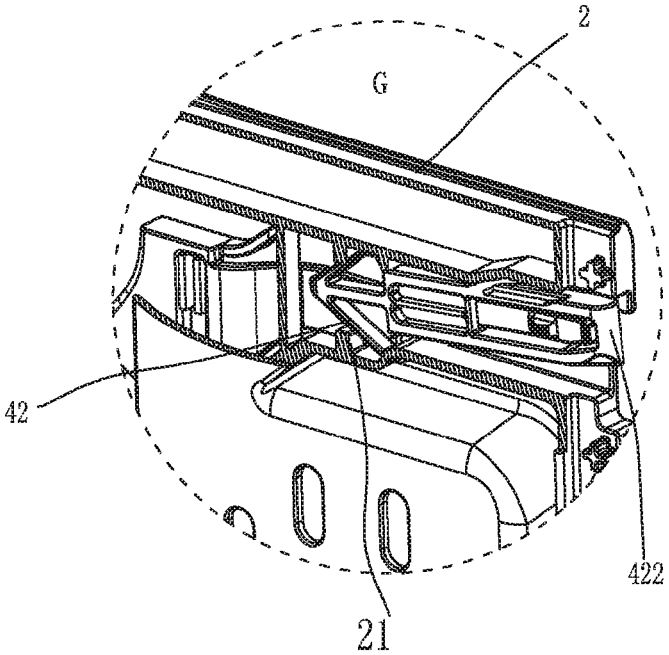
Figure 16:
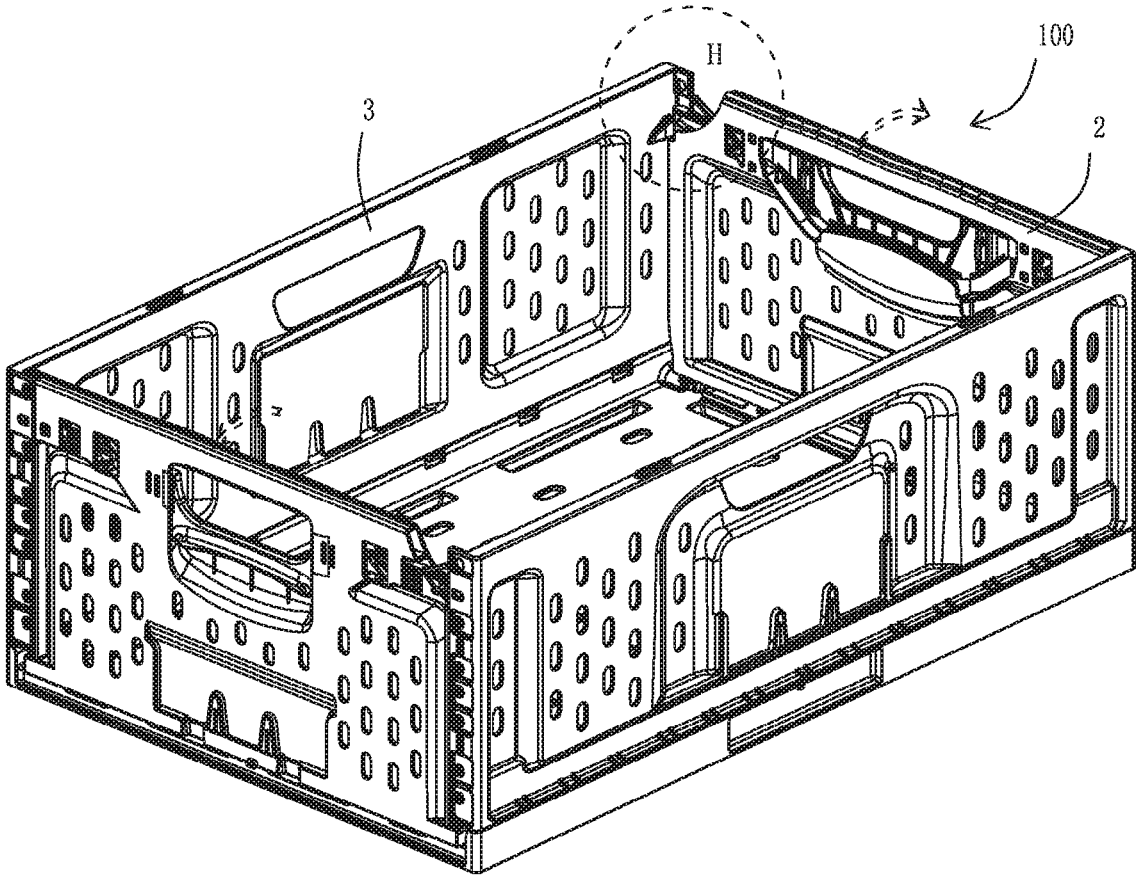
FIG. 16 is a perspective view the folding box of FIG. 1 viewed from another perspective.

The locking member 42 is provided with a locking guide slope 425 (as shown in FIG. 10) corresponding to the first guide slope 4111 at the same end as the V-shaped elastic piece 421. Upon unlocking, the locking guide slope 425 can move along the handle guide slope 4111.

Figure 3A:
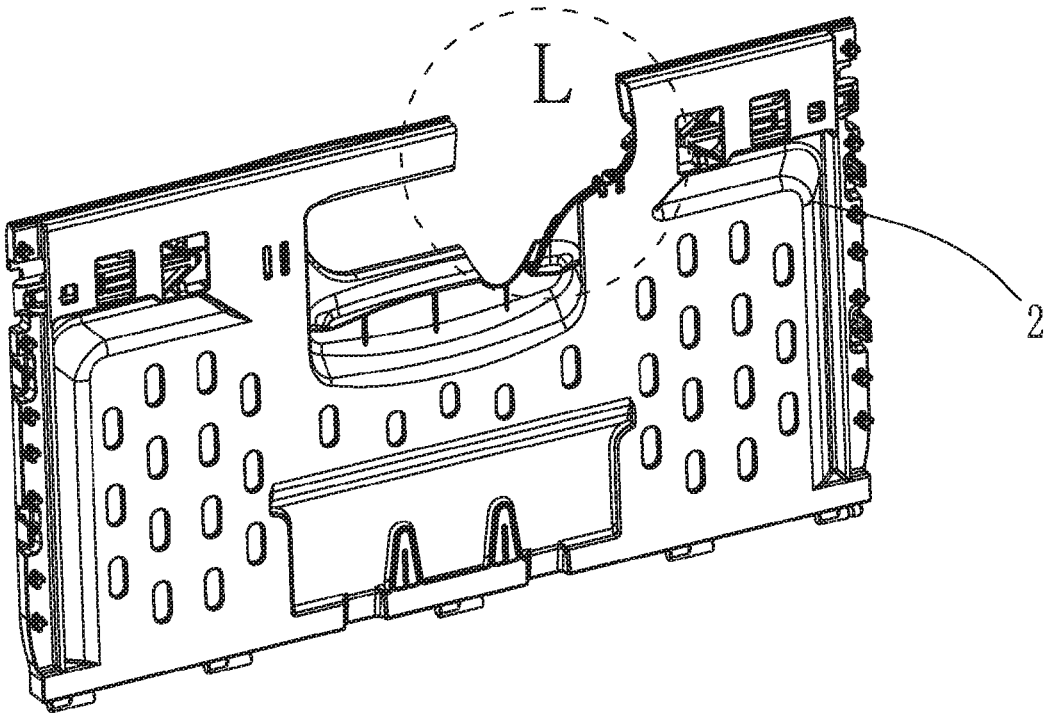
FIG. 3*a* is a perspective view of the first side plate on which the locking mechanism of FIG. 2 is mounted.
Figure 3B:
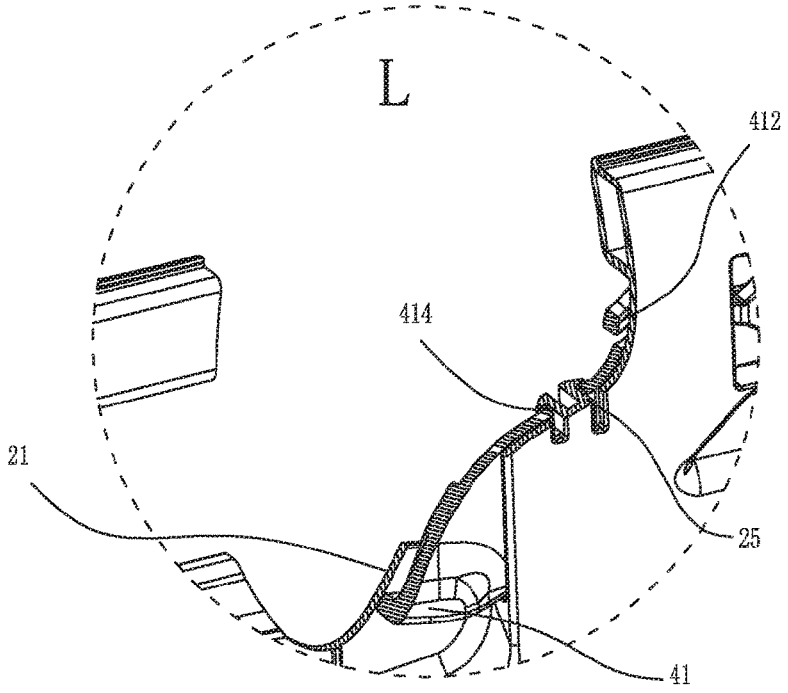
FIG. 3*b* is an enlarged view of the part L of FIG. 3*a;*
Figure 4:
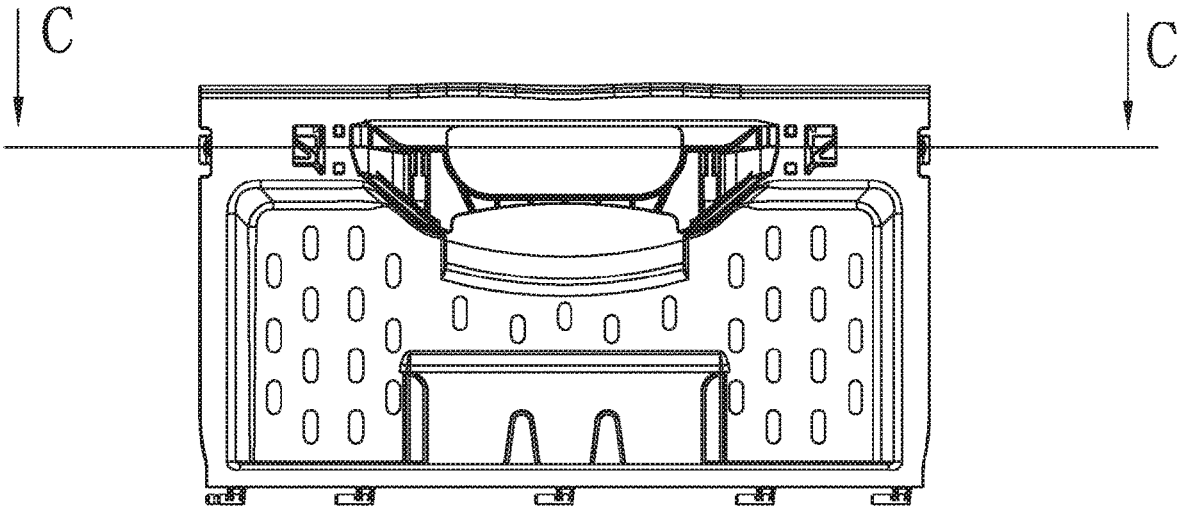
FIG. 4 is a front view of a side plate provided with locking mechanism of FIG. 2.
Figure 5:
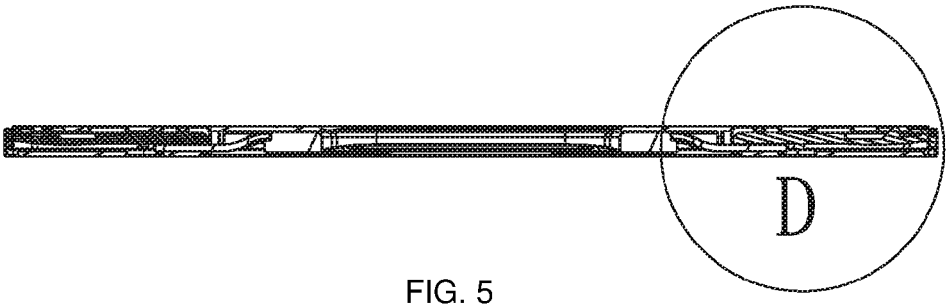
FIG. 5 is a cross-sectional view along line C-C of FIG. 4.
Figure 6:
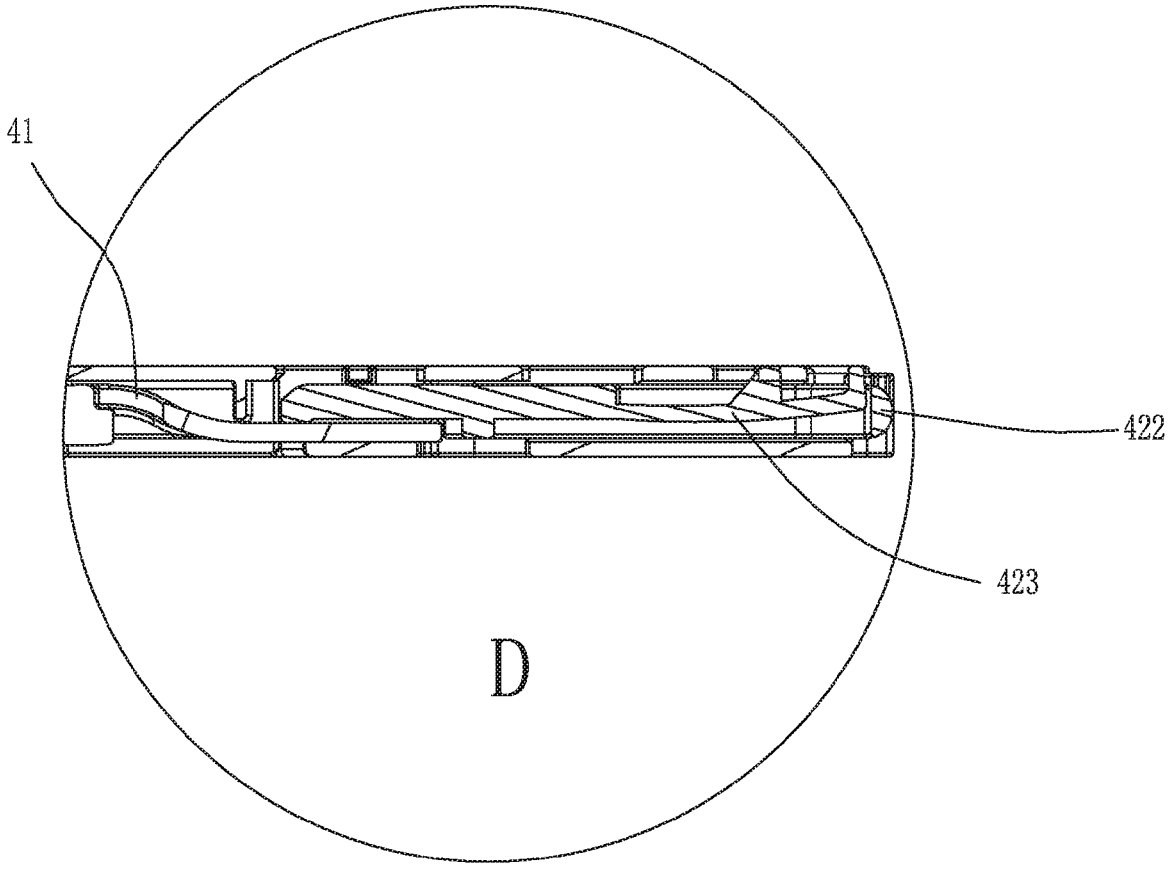
FIG. 6 is an enlarged view of part D of FIG. 5.

As shown in FIGS. 3*a* and 3*b*, the inner wall of the first side plate 2 extends a mounting wall 21 parallel to the inner wall of the first side plate. A hook 25 is also formed on the inner wall of the side plate. At the time of assembly, the handle 41 is housed in the space formed between the inner wall of the first side plate and the mounting wall 21, and the hook 25 is engaged with the trough 414 so that the handle can slide up and down along the first side plate 2. It is to be noted that the hook herein may also be provided on the handle, and accordingly, the trough is provided on the first side plate, which can achieve the same function as well.

Figure 7:
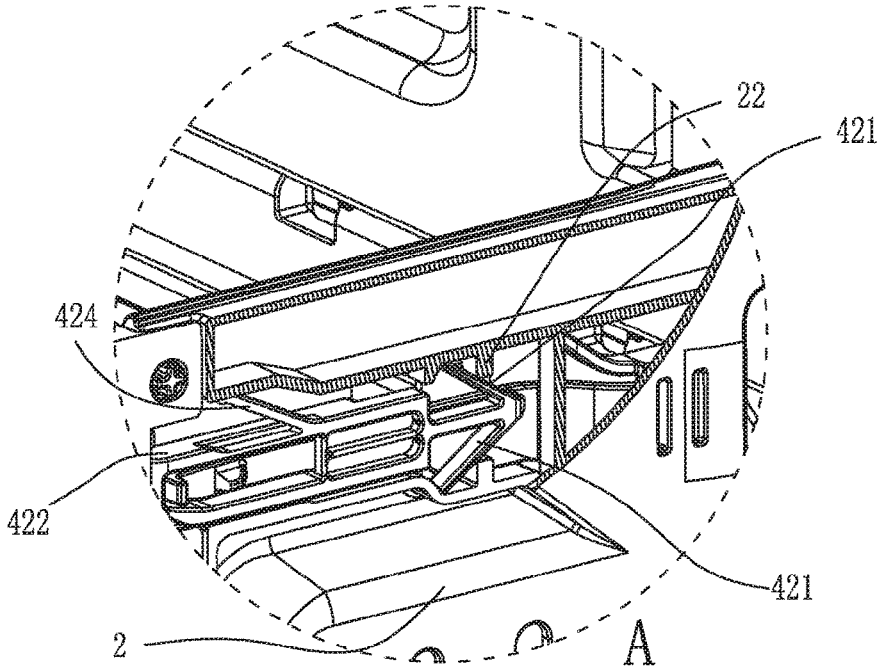
FIG. 7 is an enlarged view of part A of FIG. 1.
Figure 8:
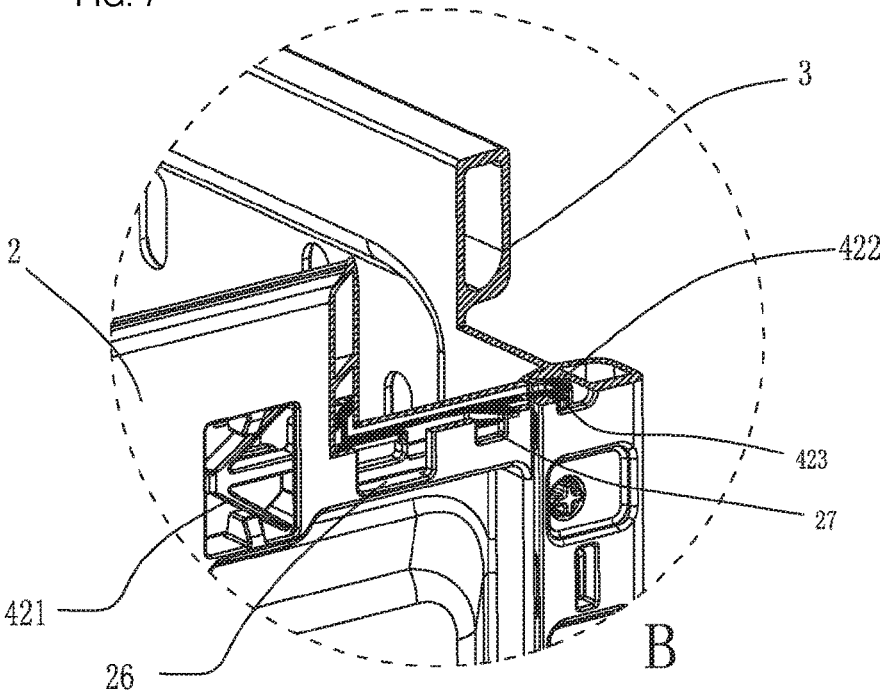
FIG. 8 is an enlarged view of part B of FIG. 1.
Figure 9:
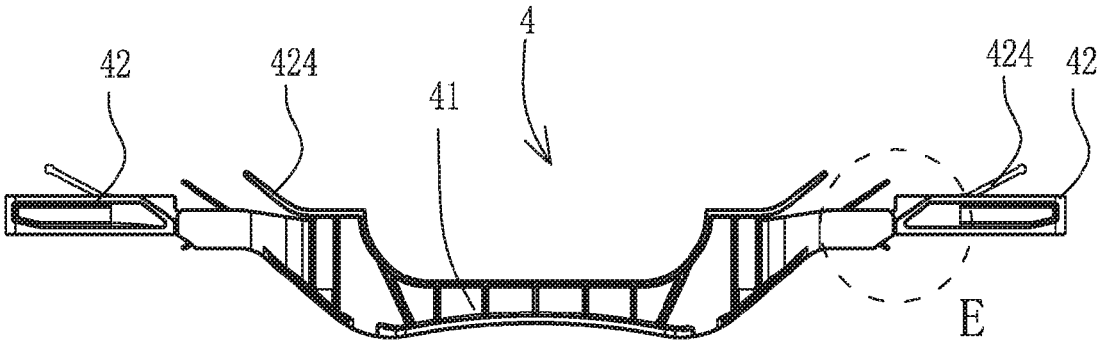
FIG. 9 is a front view of the locking mechanism of FIG. 2 in the locked state.
Figure 22:
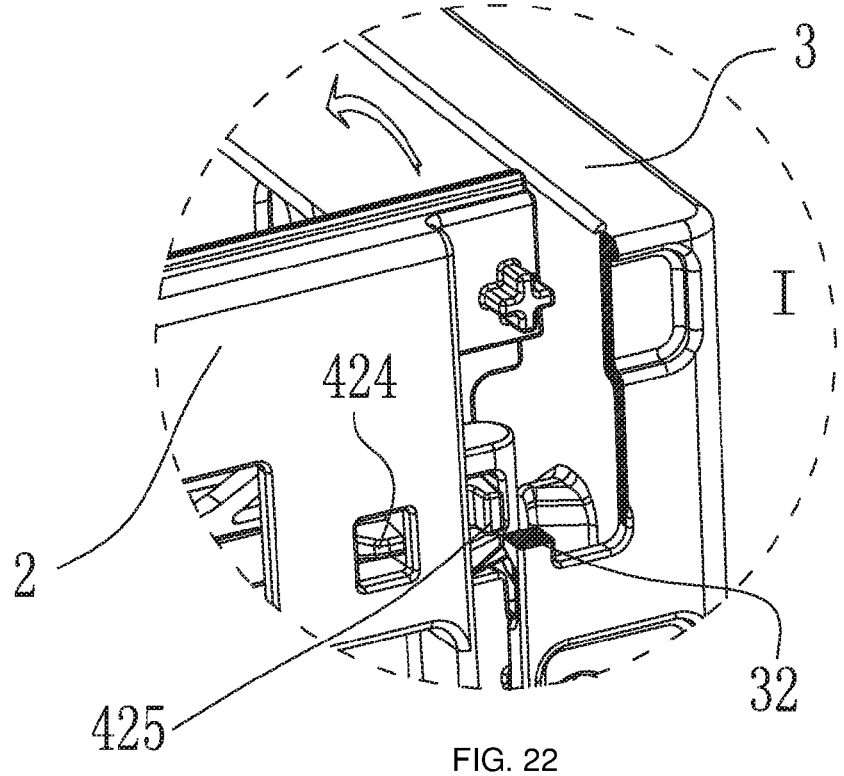
Figure 23:
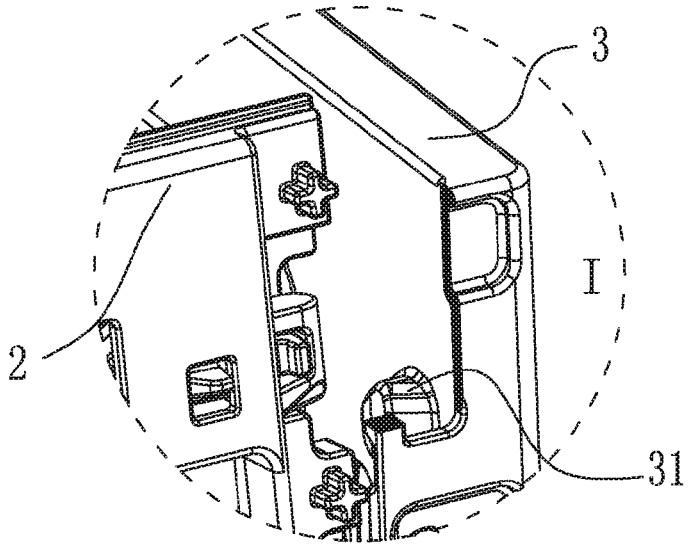

The first side plate 2 is also provided with a stopper hole 26 and a trigger hole 27 (for example, shown in FIGS. 7 and 8). The inner side of the first side plate 2 is provided with a stopper rib 22. And the second side plate 3 is provided with a trigger portion 32 (as shown in FIG. 22), wherein the stopper projection 424 provided on the locking member is engaged with the stopper hole 26 so that the locking member 42 can be kept in the unlocked state. The trigger projection 425 is engaged with the trigger portion 32 so that the stopper projection 424 can be disengaged from the stopper hole 26. The stopper rib 22 is engaged with the V-shaped elastic piece so that the V-shaped elastic piece can be deformed upon unlocking and drive the locking member 42 to reset upon locking.

The inner wall of the second side plate 3 is provided with a projection (also referred to as a stop portion) 31 with a guide slope 311 near the first side plate. And both edges of left side and right side of the second side plate 3 extend a connection portion 33. Under the locked state, one end (latch end) of the locking member 42 is located between the projection 31 and the connection portion 33 and is confined by the projection 31 and connection portion 33.

The locking and unlocking (folding and unfolding) process of the folding box according to the present invention is as follows: when side plates are folded or unfolded upright, the arc surface of the latch provided on the first side plate 2 guides to the guide slope of the stop portion on the second side plate, so as to facilitate the latch to eject back toward the middle of the first side plate or to swing toward the upper edge of the first side plate. The V-shaped elastic piece is used to drive the latch to move out toward the outer edge of the first side plate (the reset when the arc surface of the latch crosses over the stop of the long side plate, then ejects to the direction of the long side plate) when the first side plate and the second side plate are locked. The third latch tab 424 is used when the latch is in full release (i.e., the latch is in a locked and extended state) while the first side plate is in folded state, at this time, the first side plate is moved in upright direction (the box is unfolded and locked), and the latch will guide along the stop of the second side plate, forcing the third latch tab 424 to elastically deform, the latch swinging toward the upper edge of the first side plate. When the latch crosses over the stop of the long side plate, the outer side of the third latch tab is always confined in the corresponding mounting portion of the first side plate, and the latch tab is pushed between the stop of the second side plate and the connection portion of the second side plate via a resilient reset so that the long side plate is in the locked state. Upon unlocking, the handle is first lifted upwards to provide an avoid space for the movement of the locking member, and the first side plate is pushed inwardly, the latch guiding along the guide slope of the stop of the second side plate, forcing it to retract toward the middle of the first side plate. And when the latch is about to cross over the stop, the oppressed second latch tab 423 restores and ejects with the stopper projection 424 provided on the second latch tab 423, entering the stopper hole 26 of the first side plate. At the same time, the stopper projection 424 of the second latch tab 423 is anchored in the stopper hole 26, so that the latch in the unlocked state. Upon locking, the first side plate moves in the upright direction, and the trigger projection 425 of the latch touches the edge of end face of the long side plate (i.e., the trigger portion 32 on the connecting portion 33), forcing the trigger projection 425 of the latch to retreat and causing the second latch tab 423 deform in the direction of the inside of the box while the stopper projection 424 of the latch also disengages from the stopper hole 26 of the first side plate. And the latch is pushed between the stopper of the second side plate and the connection portion end via the resilient reset of the V-shaped elastic piece (first latch tab) so that the first side plate and the second side plate are in the locked state.

Figure 24:
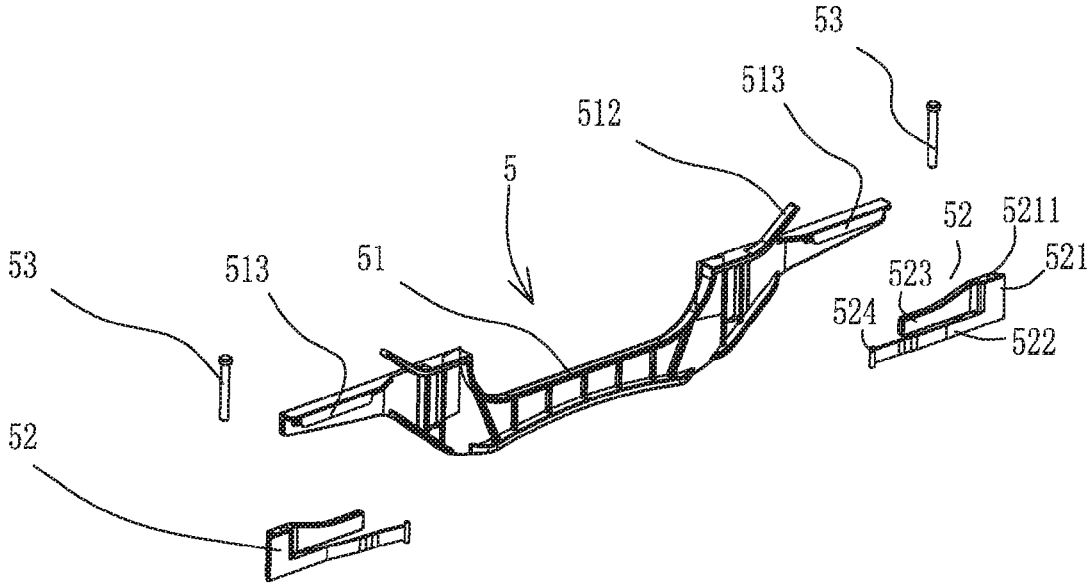
FIG. 24 shows an exploded perspective view of a locking mechanism according to another embodiment of the present invention.
Figure 25:
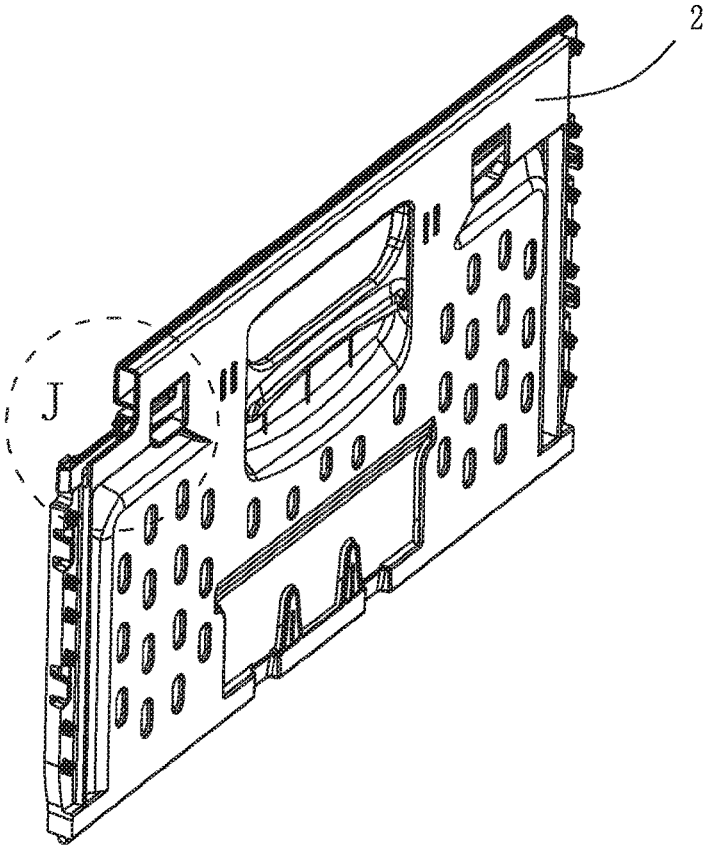
FIG. 25 is a perspective view of the side plates provided with the locking mechanism of FIG. 24, part of which is cut to show part of the locking mechanism.
Figure 26:
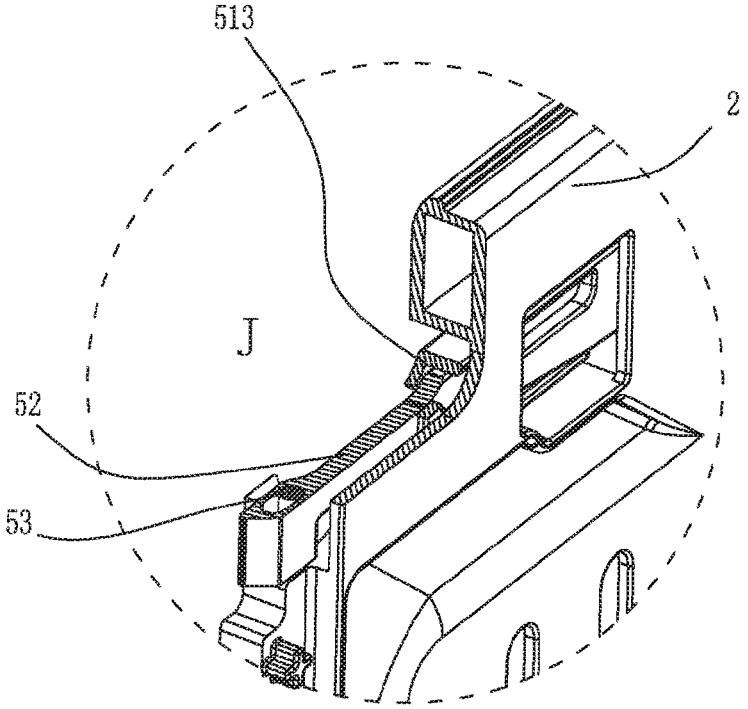
FIG. 26-28 is an enlarged view of part J of the FIG. 25, showing the unlocking process of the adjacent side plates of the folding box.
Figure 27:
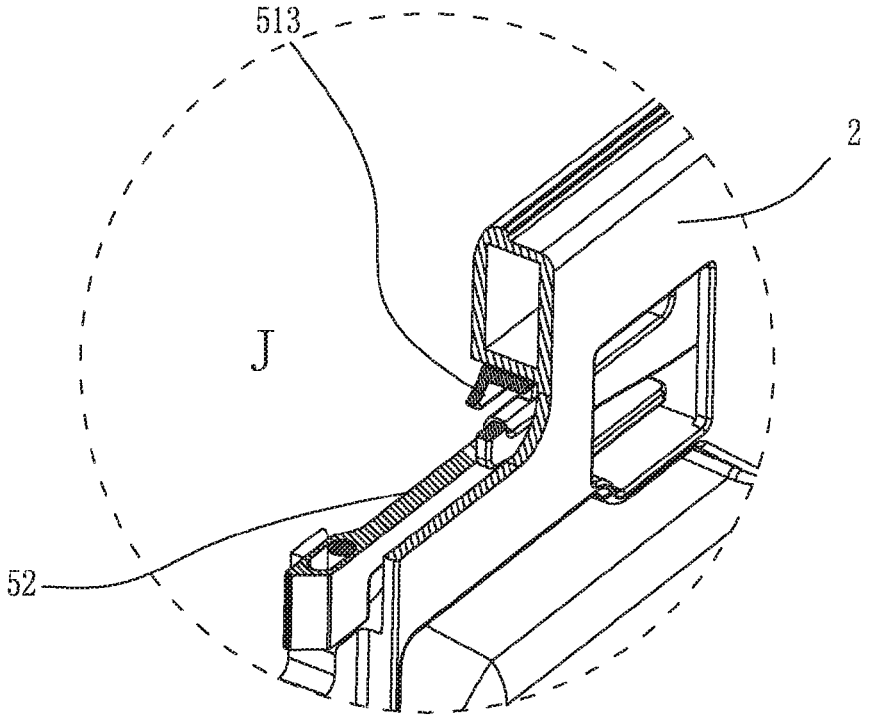
Figure 28:
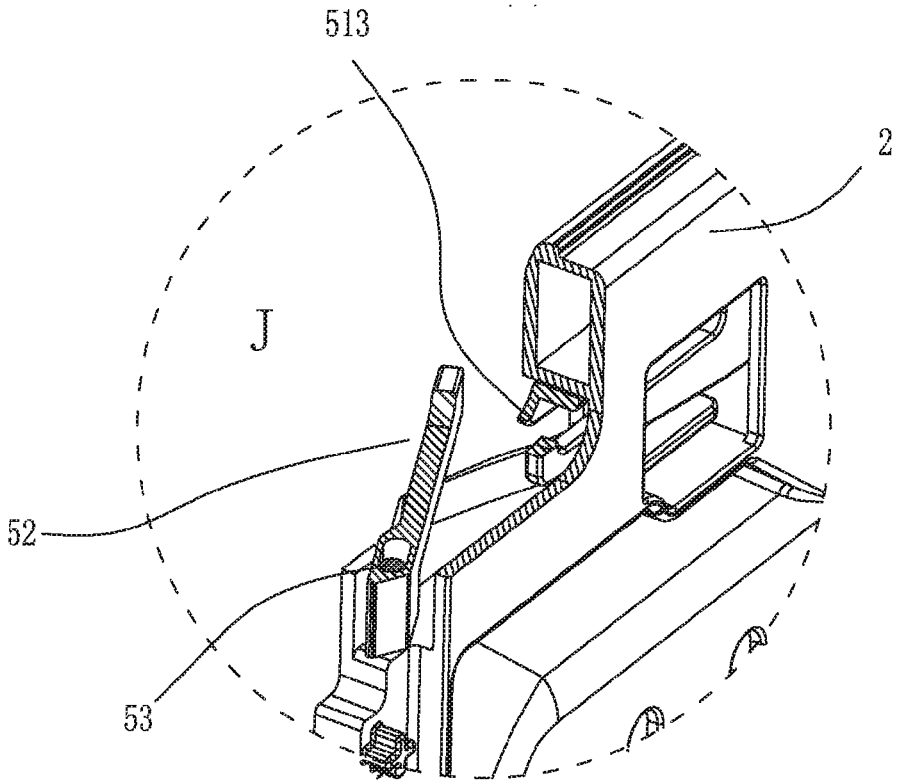
Figure 29:
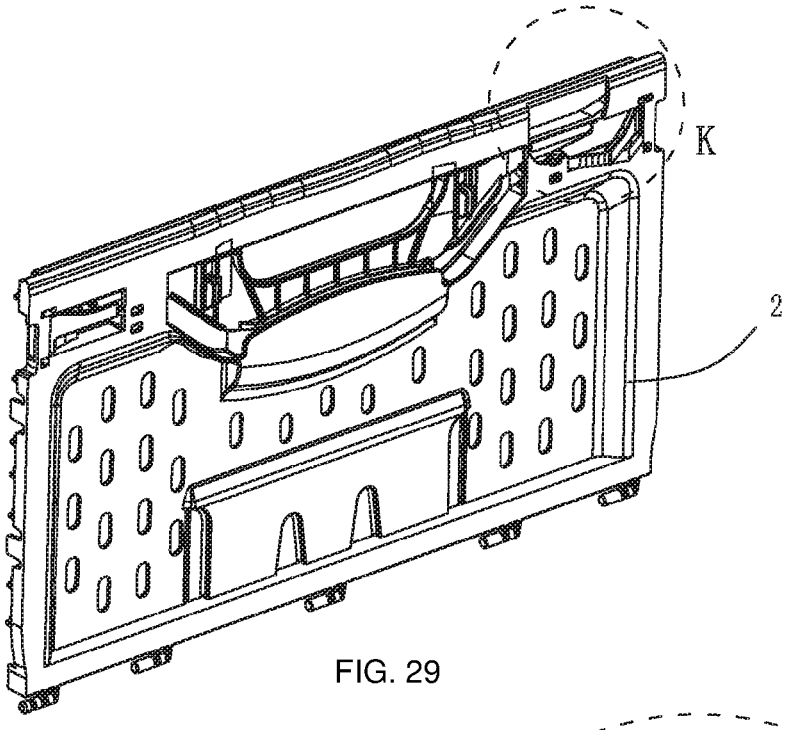
FIG. 29 is another perspective view of the side plates provided with the locking mechanism of FIG. 24.

FIG. 24 to FIG. 30 show a locking member 5 of the folding box according to a second embodiment of the present invention. As shown in FIG. 24, both ends of the handle 51 are provided with a gripping portion 513. When the first side plate 2 and the second side plate 3 are in the locked state, one end of each of two locking members 52 are held by both ends of the handle respectively by means of the gripping portion 513 (shown in FIG. 26). While the handle moves up or down by a predetermined distance and the first side plate is pushed inwardly, griping ends 513 at both ends of the handle disengage from the locking member 52 (shown in FIG. 28).

Figure 30:
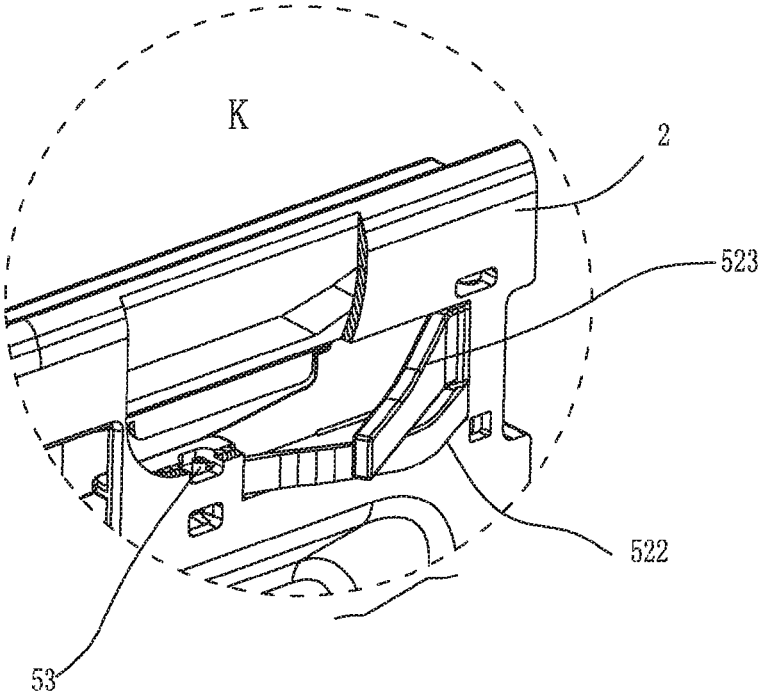
FIG. 30 is an enlarged view of part K of the FIG. 29.

Also as shown in FIG. 24, the locking member 52 is provided with a latch 521 and a latch tab 522. The latch 521 is provided with an elongated hinge hole 5211. One end of the latch toward the second side plate extends a clamped end 523. One end of the latch tab 522 is fixed on the latch, and the other end is provided with a hinge pin 524. At the time of assembly, the latch 521 movably connects to the first side plate, and the latch tab 522 is hinged to the first side plate 2, as shown in FIG. 30.

When the first side plate 2 and the second side plate 3 are in a locked state, the clamped end of the latch 52 is held by the gripping portion 513 of the handle, and the other end of the latch 52 extends into the second side plate, and specifically extends between the projection (the stop) of the second side plate and connection portion. Upon unlocking, the clamped end of the latch disengages from the gripping portion of the handle and the latch is engaged with guide slope of the projection so that the latch is disengaged from the second plate and unlocked. Specifically, upon unlocking, when the handle is lifted up, the griping portion of the handle disengages from the latch 52, at the same time, the side plate is pushed toward the folding direction (toward the inside of the folding box), and the end of the latch interferences with the stop of the side plate to force the latch elastic piece to elastically deform (inwardly curved), and at this time the latch is guided along the slope of the stop of the second side plate and retracts toward the middle of the first side plate so as to be unlocked. After the latch crosses over the stop, the latch is ejected and substantially parallel to the first side plate by recovery of the latch tab, and when the first plate is locked upright, the latch guides along the slope of the stop of the side plate to deform the elastically shrapnel so as to retract back to the middle of the side plate. After crossing over the stop, the elastic piece is restored, the latch extends and the side plate is locked.

Figure 31:
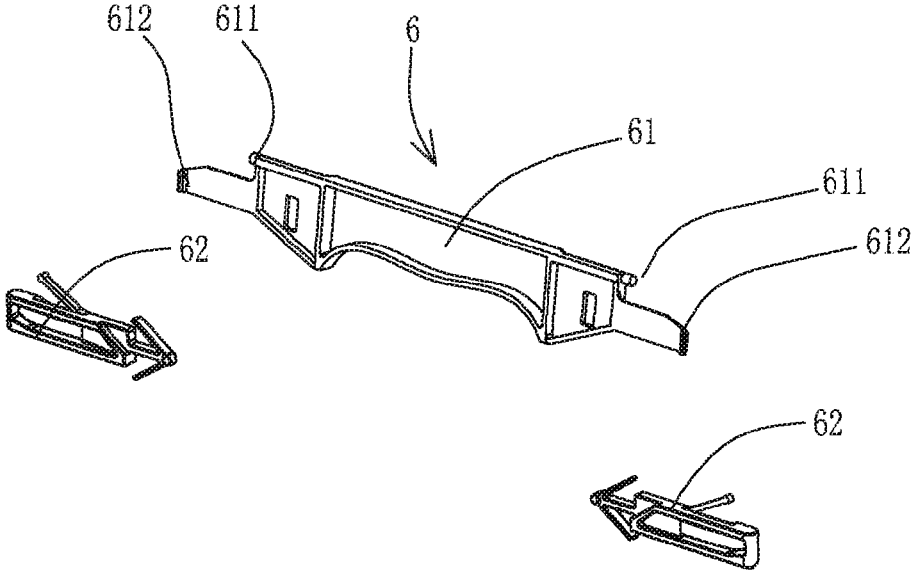
FIG. 31 is an exploded perspective view of the locking mechanism according to another embodiment of the present invention.
Figure 32:
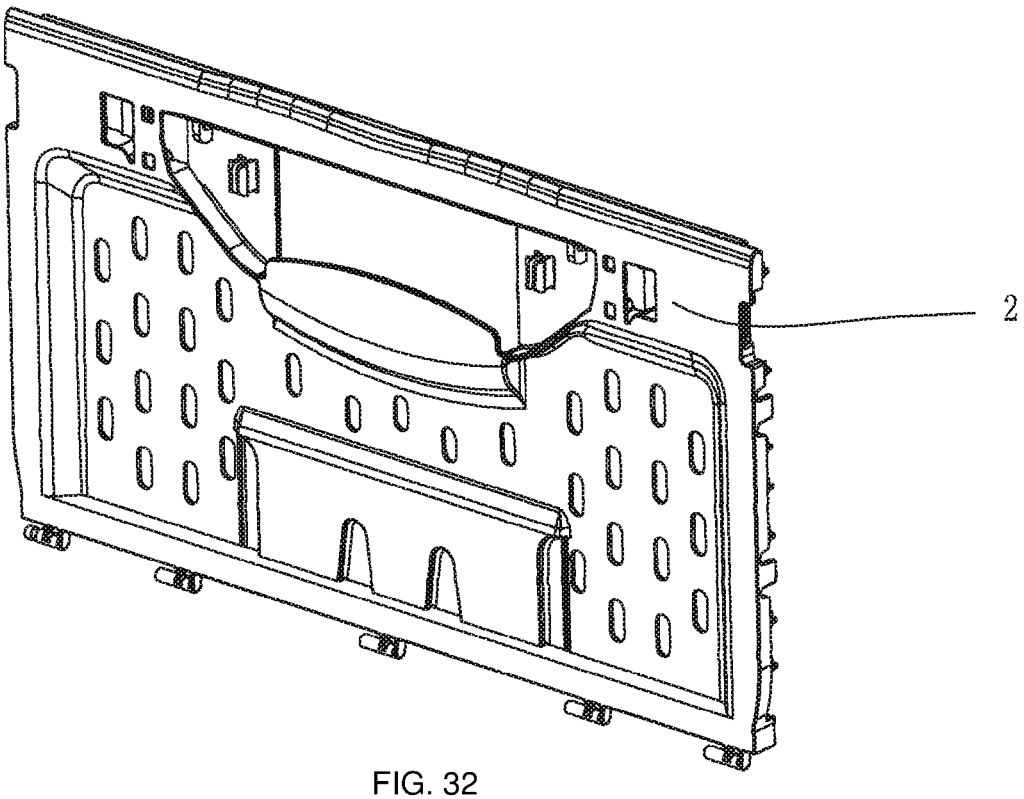
FIG. 32 is a perspective view of the side plates used for mounting the locking mechanism of FIG. 31.

FIG. 31-32 show a modified example of the embodiment shown in FIGS. 1-23. The locking member 6 of the embodiment differs from the embodiment shown in FIGS. 1-23 in that the handle 6 is rotatabely mounted to the first side plate 2 via a pin 611. The handle 61 rotates inwardly when the side plate is unlocked, so that the farthest end 612 of the handle dislocates from the latch 52 so that the latch has a space to retract toward the middle of the side plate. The rest is basically the same, no longer elaborate here.

It is to be noted that the principle of the present invention is that: under the locked state, the handle limits movement of the locking member so that the adjacent two side plates remain in locked state, and under the unlocked state, the handle moves to provide an avoiding space for the locking member, where the locking member can cooperate with the guide feature and retract into the first side plate. The manner in which the handle moves herein included suitable means such as moving up and down, moving left and right or rotating about an axis, as long as the handle is moved to provide the locking member with avoid space retracting back to the inside of first side plate.

While the preferred embodiments of the present invention have been described in detail above, it will be understood by those skilled in the art that various changes and modifications can be made herein without departing from the above teachings of the present invention. These equivalents are also intended to be within the scope of the claims appended hereto.

The invention claimed is:

1. A folding box comprising a bottom plate, a pair of first side plates and a pair of second side plates, the first side plates and the second side plates hinged to the bottom plate and foldable with respect to the bottom plate, the first side plates and the second side plates releasably interlocked via a locking mechanism, wherein the locking mechanism comprises:

a handle movably mounted on the first side plates;

a locking member for interlocking adjacent the first side plates and the second side plates; and a guide feature provided on the second side plates, wherein when the first side plates and the second side plates are in a locked state, the handle restricts a position of the locking member which limits movement of the locking member, and after the handle moves and provides the locking member with space for movement, the locking member cooperates with the guide feature to drive the locking member to move and be unlocked.

2. The folding box according to claim 1, wherein the locking member includes a latch and a first latch tab, the latch configured to cooperate with the guide feature to drive the first latch to move and drive the first latch tab to deform and be unlocked, and upon locking, the first latch tab can reposition and drive the latch to reset.

3. The folding box according to claim 1, wherein the second side plates include a stop, and both left and right edges of the second side plates extend vertically forming a connection portion, and upon locking, one end of the locking member is located between the stop and the connection portion, and the guide feature is provided on the stop.

4. The folding box according to claim 1, wherein first side plates include a mounting wall extending parallel to an inner wall of the first side plates, and one of the first side plates and the handle includes a hook and the other includes a trough, the handle housed in a space formed between the inner wall of the one of the first side plates and the mounting wall, the hook cooperating with the trough allowing the handle to slide up and down along the one of the first side plates.

5. The folding box according to claim 1, wherein one end of the locking member includes a latch, and the other end includes a first latch tab, and an outer side of the locking member includes a stopper projection and a trigger projection, one of the first side plates includes a stopper hole and a trigger hole and inner side of the one of the first side plates including a stop, and one of the second side plates including a trigger portion, wherein the stopper projection is engaged with the stopper hole for holding the locking member in the locked state, and the trigger projection is configured to cooperate with the trigger portion to disengage the stopper projection from the stopper hole, and the stop is configured to cooperate with the first latch tab so that the first latch tab is deformed upon unlocking and to drive the locking member to reset upon locking.

6. The folding box according to claim 1, wherein the locking member includes a latch and a first latch tab, one end of the first latch tab cooperates with the first side plates, and the other end of the first latch fixed on the latch, and when the first side plates and the second side plates are in the locked state, the one end of the latch is restricted by, while the other end of the latch extends into the second side plates, and upon unlocking, the one end of the latch disengages from the handle and the other end of the latch cooperates with a stop feature so that the latch disengages from the second side plates and unlocked.

7. The folding box according to claim 1, wherein the handle and the locking member are configured such that when the first side plates and the second side plates are in the locked state, both ends of the handle respectively abut against one end of two locking members, while after the handle moves a predetermined distance, both ends of the handle disengage from the locking member.

8. The folding box according to claim 1, wherein both ends of the handle are provided with a gripping portion, and when the first side plates and the second side plates are in the locked state, both ends of the handle hold one end of two locking member respectively, while after the handle moves a predetermined distance and the first side plates is pushed toward the inside of the folding box, the gripping portion of both ends of the handle disengages from the locking member.

9. The folding box according to claim 8, wherein a stop feature is configured as a projection on an inner wall of the second side plates and includes a guide slope, and the locking member includes a latch and a first latch tab, and one end of the first latch tab cooperates with the first side plates, and the other end is fixed on the latch, when the first side plates and the second side plates are in a locked state, one end of the latch is held in the gripping portion of the handle while the other end of the latch extends into the second side plates, upon unlocking, one end of the latch disengages from the handle and the other end of the latch cooperates with the raised guide slope so that the latch disengages from the second side plates and thus being unlocked.

10. A folding box comprising a bottom plate, a pair of first side plates and a pair of second side plates, the first side plates and the second side plates hinged to the bottom plate and foldable with respect to the bottom plate, the first side plates and the second side plates releasably interlocked via a locking mechanism, wherein the locking mechanism comprises:

a handle movably mounted on the first side plates;

a locking member for interlocking adjacent the first side plates and the second side plates and provided with a latch and a first latch tab; and a guide feature provided on the second side plates, wherein when the first side plates and the second side plates are in a locked state, the handle restricts a position of the locking member which limits movement of the locking member, and after the handle moves and provides the locking member with the space for movement, the locking member cooperates with the guide feature to drive the latch to move and drive the first latch tab to deform and be unlocked, and upon locking, the first latch tab can reposition and drive the latch to reset.

11. The folding box according to claim 10, wherein the locking member further comprises a second latch tab provided on an outer side of the locking member, and the second latch tab includes a stopper projection and a trigger projection, and the first side plates are respectively provided with a stopper hole for housing the stopper projection and a trigger hole for housing the trigger projection, wherein the stopper projection cooperates with the stopper hole so that the locking member can be held in an unlocked state, and the trigger projection configured to be triggered by the second side plates to disengage the stopper projection from the stopper hole.

12. The folding box according to claim 10, wherein the locking member further comprises the third latch tab provided on an upper side or a lower side of the locking member, and the third locking tab configured to cooperate with the first side plates.

13. The folding box according to claim 11, wherein the locking member further comprises the third latch tab provided on an upper side or a lower side of the locking member, and the third locking tab configured to cooperate with the first side plates.

* * * * *